US007644909B2

(12) United States Patent
Huhta-Koivisto et al.

(10) Patent No.: US 7,644,909 B2
(45) Date of Patent: Jan. 12, 2010

(54) APPARATUS AND METHOD FOR AERATION/MIXING OF WATER

(75) Inventors: Risto Huhta-Koivisto, Espoo (FI); Esko Huhta-Koivisto, Espoo (FI)

(73) Assignee: Waterix Oy, Espoo (FI)

( * ) Notice: Subject to any disclaimer, the term of this patent is extended or adjusted under 35 U.S.C. 154(b) by 615 days.

(21) Appl. No.: 10/588,253

(22) PCT Filed: Jan. 26, 2005

(86) PCT No.: PCT/FI2005/000051

§ 371 (c)(1),
(2), (4) Date: Aug. 2, 2006

(87) PCT Pub. No.: WO2005/070526

PCT Pub. Date: Aug. 4, 2005

(65) Prior Publication Data

US 2007/0063362 A1 Mar. 22, 2007

(30) Foreign Application Priority Data

Jan. 27, 2004 (FI) ..... 20040113

(51) Int. Cl.
*B01F 3/04* (2006.01)

(52) U.S. Cl. ..... 261/91; 261/115

(58) Field of Classification Search ..... 261/84, 261/91, 115, 120, 121.1, DIG. 71
See application file for complete search history.

(56) References Cited

U.S. PATENT DOCUMENTS

| | | | | |
|---|---|---|---|---|
| 780,780 | A | 1/1905 | Culley | |
| 1,867,824 | A * | 7/1932 | Hammerly | 210/198.1 |
| 1,992,762 | A * | 2/1935 | Pease | 95/219 |
| 2,165,889 | A * | 7/1939 | Fischer et al. | 261/93 |
| 2,186,371 | A * | 1/1940 | Durdin, Jr. | 210/703 |
| 3,416,729 | A * | 12/1968 | Ravitts et al. | 239/16 |
| 3,737,105 | A | 6/1973 | Arnold et al. | |
| 3,771,724 | A * | 11/1973 | Rose et al. | 239/221 |
| 3,797,809 | A * | 3/1974 | Sydnor, Jr. | 261/91 |
| 3,871,581 | A | 3/1975 | Dively | |
| 3,911,065 | A * | 10/1975 | Martin et al. | 261/91 |
| 3,998,389 | A | 12/1976 | Rose | |
| 4,089,620 | A * | 5/1978 | Ravitts | 417/61 |
| 4,318,871 | A | 3/1982 | Mentz | |
| 4,358,413 | A | 11/1982 | Brucker | |
| 4,468,358 | A * | 8/1984 | Haegeman | 261/91 |
| 4,482,510 | A * | 11/1984 | Khudenko | 261/91 |
| 5,021,154 | A | 6/1991 | Haegeman | |
| 5,707,562 | A * | 1/1998 | Karliner | 261/91 |
| 2003/0011082 | A1 * | 1/2003 | Tanabe et al. | 261/91 |

FOREIGN PATENT DOCUMENTS

| | | |
|---|---|---|
| DE | 2811990 | 9/1979 |

* cited by examiner

*Primary Examiner*—Scott Bushey
(74) *Attorney, Agent, or Firm*—Fasth Law Offices; Rolf Fasth

(57) ABSTRACT

The aeration system is for aeration and/or mixing of water, which system has at least one aeration unit that has a pump/propeller inside a feed pipe. The feed pipe, to which the water to be aerated, is sucked from beneath. The aeration system has the feed pipe expanding in the upper part of the aeration unit to a conical space working as a nozzle, via which the water continues its way to at least one annular opening.

14 Claims, 8 Drawing Sheets

APPARATUS AND METHOD FOR AERATION/MIXING OF WATER

PRIOR APPLICATIONS

Figure 1:
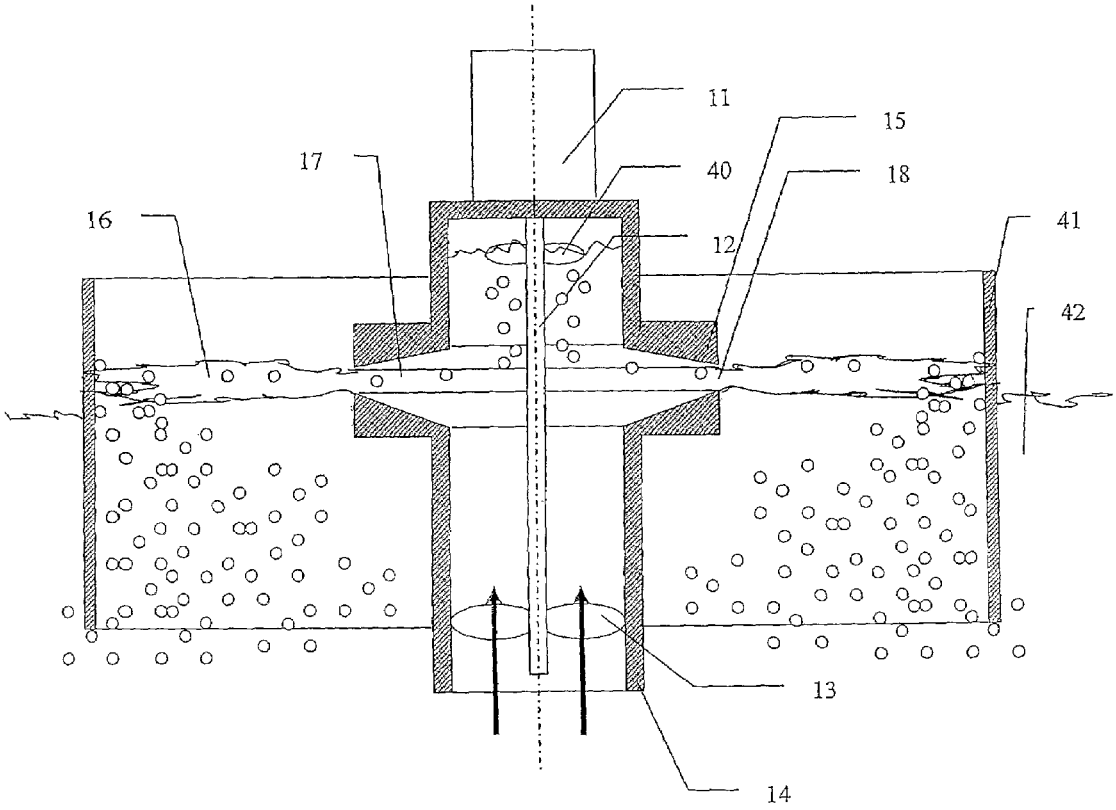

This is a US national phase patent application that claims priority from PCT/FI2005/000051, filed 26 Jan. 2005, that claims priority from Finnish Patent Application No. 20040113, filed 27 Jan. 2004.

TECHNICAL FIELD

The invention is concerned with an aeration system and method for mixing and/or aeration of water.

BACKGROUND ART

Biological treatment is an important phase in the treatment of wastewaters and it is also the phase consuming most energy. In biological treatment carried out by means of aeration, it is necessary to continuously feed oxygen into the water in order to enable bacterial activity in the process. The oxygen concentration decreases also in natural waters during the long winter season, when the ice covering prevents a natural oxidation through the air. This phenomenon might lead to oxygen depletion, death of fish and a final pollution of the lake. Biological treatment is also used for e.g. removal of gases, such as radon, from the water by aeration.

Bottom aeration is the most common way for aeration of waters. In this method, air is pumped into the water through a membrane with holes on the bottom of the basin. Attempts have been made to start using surface aeration instead of bottom aeration, primarily of maintenance reasons. In these methods, air has been fed to rotating propellers on or near the surface of the water, which propellers have mixed air with streaming water. Also such devices are known, in which different flow pieces have been placed in the streams created by the propellers in order to improve the transfer of the air into the water and the mixing of the air with the water. The main drawback with these devices is their contamination and clogging in use. In addition, they have often required separate water mixers to keep the whole water content in the basin in a sufficient movement, whereby the waste water sludge can be prevented from falling down to the bottom of the basin.

Also such apparatuses have been used in aeration, wherein the water has been lead, by means of a pump, to a cylindrical space above the water. The cylindrical space has had a number of holes, through which the water has been ejected to the surface of the water.

In addition, ejectors have been used for aeration, in which a water jet has sucked air in itself and this jet has then been lead to the bottom of the basin, whereby circulation has been achieved in the basin at the same time. Characteristic for all surface aeration devices have been their efficiency, in other words, the amount of dissolved oxygen in each energy unit has been low.

The aeration causes ca 80% of the energy costs of a waste water treatment plant (i.e. an activated sludge plant, i.e. a plant using biological treatment) and this electricity consumption corresponds to ca 30% of the operational costs of the waste water treatment plant. The energy consumption is therefore of essential importance in aeration.

Typical oxidation effects in practice are, when it is question about a fine bubble aeration unit, which works as a bottom aerator: 1.7-3.0 kgO2/kWh, a coarse bubble aerator which works as a bottom aerator: 1.7-2.3 kgO2/kWh, a surface aerator: 1.3-2.2 kgO2/kWh or a combination aerator (OKI): 1.5-3.2 kgO2/kWh. The maintenance of a bottom aerator is difficult. Usually, the basin has to be emptied for the service (a part of them having separate bottom floats, which can be lifted one by one). In addition, the service is expensive and takes several weeks. For an example customer, the aeration system (including aeration plates, pipes, the installation, a compressor hall and the compressors) has cost 300.000 EUR. The service, which has to be performed with intervals of 4-6 years, costs 40-50.000 EUR.

In biological wastewater treatment there is often used both aerobic and anaerobic phases. The aerobic one requires oxidation and mixing, while the anaerobic one, in turn, requires an oxygen free environment and mixing. In the aerobic phase, biochemical load is typically removed from the wastewater and ammonium nitrogen is converted to nitrate by nitrification. In the anaerobic phase, the nitrogen in the wastewater is brought into a gaseous form and removes from the waste water. When the bottom aerators are stopped in the anaerobic phase, the water has to be mixed with separate mixers. This, in turn, increases the investments and number of objects to be maintained. In a part of the wastewater treatment plants, separate basins are used for the removal of nitrogen so that it would not be necessary to interrupt the bottom aeration. This, again, increases the investments. The bottom aerators gradually become clogged and their result worsens, especially if the aeration is often interrupted. By time, the effect of the bottom aerators lowers to 5-50% of the nominal effect.

Bottom aeration works best in basins 6-9 m deep, whereby the best efficiency is achieved. In low basins, the efficiency lowers fast, in very deep basins the compressed air has to be cooled to prevent the membranes of rubber/plastic from destruction. This increases both investments and operational costs.

The problem with surface aerators is the bad efficiency of the oxidation, the weak adjustability and the fact that the basin has to be rather low. A typical depth is 3.5 m, which makes the surface of the basins large and neither is their form optimal (expensive to make). A possibility to adjust would be important since the need of oxygen varies essentially e.g. when the load changes. Different surface aerators have been presented in e.g. the U.S. Pat. Nos. 5,021,154, 3,928,512 and 4,193,951.

The EP publication 465043 is also presented as prior art.

SUMMARY OF THE INVENTION

In order to avoid these and later appearing disadvantages and to achieve some other goals of the invention, the invention is concerned with an aeration system for aeration and/or mixing of water, which system comprises at least one aeration unit having a pump/propeller inside a feed pipe and a feed pipe, to which the water to be aerated is sucked from beneath. The aeration system is characterized in that, the feed pipe is expanding in the upper part of the aeration unit to a conical space working as a nozzle, via which the water continues its way to at least one annular opening.

The method of the invention is, in turn, characterized in that the water stream achieved with the propeller pump is lead to the feed pipe. The water is lead from the feed pipe via the part in the upper part of the feed pipe that expands to a conical space and work as a nozzle to one or more connected nozzle openings. After the nozzle opening, the underpressure of the jet is allowed to suck air in itself both from beneath and above. The water is lead away from the upper part of the aeration unit via the nozzle and further via the nozzle opening.

The preferable embodiments of the invention have the characteristics of the dependent claims.

In the apparatus of the invention, the water stream achieved with a propeller pump is lead to one or more annular nozzles on the surface of the water, in which units the water stream sucks air into it, which is efficiently mixed with the water thereby aerating it. The height of the nozzle opening should be restricted as well. Then the size of the bubbles that will be formed in the water remains small and are evenly distributed thereby enabling a high solution rate. This fact results in relatively small aeration units and most usually, the unit contains numerous aeration units. Only in the very smallest apparatuses it is possible to manage with only one aeration unit or nozzle opening.

This invention is concerned with a surface aeration apparatus/mixer. A feed pipe foreseen with a propeller pump belongs to the apparatus, with which pipe ground water poor of oxygen is sucked to the aerator. Near the surface, the feed pipe is branched into transversal feed pipes parallel with the surface. In the aeration unit, the water is lead to a circular nozzle opening. In the nozzle opening, the pressure energy is converted to kinetic energy. In this space, the water jet streaming from the nozzle opening sucks surrounding air to itself both beneath and above the jet, which is mixed with the water jet in the form of small bubbles. The jet maintains a big part of its kinetic energy until it meets the cylindrical covering or the surrounding water. The nozzle opening is vertical in order to lead the water jet out horizontally from the feed pipe or it is slanting upwards to lead the water stream out of it diagonally upwards.

When the water is taken into the apparatus from the bottom of the basin and returned back to the surface of the basin, the water of the basin will be efficiently circulated and the incoming water is as oxygen-poor as possible. This fact essentially increases the performance of the apparatus. In other aeration apparatuses, the oxygen content of the water coming to the aeration apparatus is of average level or the apparatus circulates the same relatively oxidized water. At the same time as the apparatus oxidizes efficiently, it circulates the water of the basin thereby preventing the falling of the sludge to the bottom. Thereby, there is no need for separate mixers.

As a summary, it may be stated that by calculating the oxidation efficiency of our test apparatus, one is ended up to an efficiency of 6.0 kg $O_2$/kWh for an apparatus of the invention in large scale. The energy saving is considerable.

The advantages of the new apparatus of the invention are e.g.

- A good oxidation efficiency of 6.0 kg $O_2$/kWh (normal atmosphere, 10° C.)
- In an aerobic process, the apparatus performs aeration and mixing at the same time
- In an anaerobic process, the apparatus performs mixing and causes the water to circulate without aeration, which enables e.g. removal of nitrogen in the same basin
- Easy maintenance, does not require any surrounding complex infrastructure
- The apparatus works well and with the same output in low as well as in very deep basins
- Excellent possibilities to adjust the oxidation effect, which is important with varying loads
- An external fastening of the cover prevents contamination and clogging of the nozzle and nozzle opening In the following, the invention is described in detail by referring to some embodiment examples of the figures. The invention is not restricted to the details of the figures.

The invention can e.g. be performed without any cylindrical covering or the small propeller in the upper part; this matter might e.g. depend on the size of the basin.

FIGURES

FIG. 1 presents the advantageous apparatus of the invention

Figure 2:
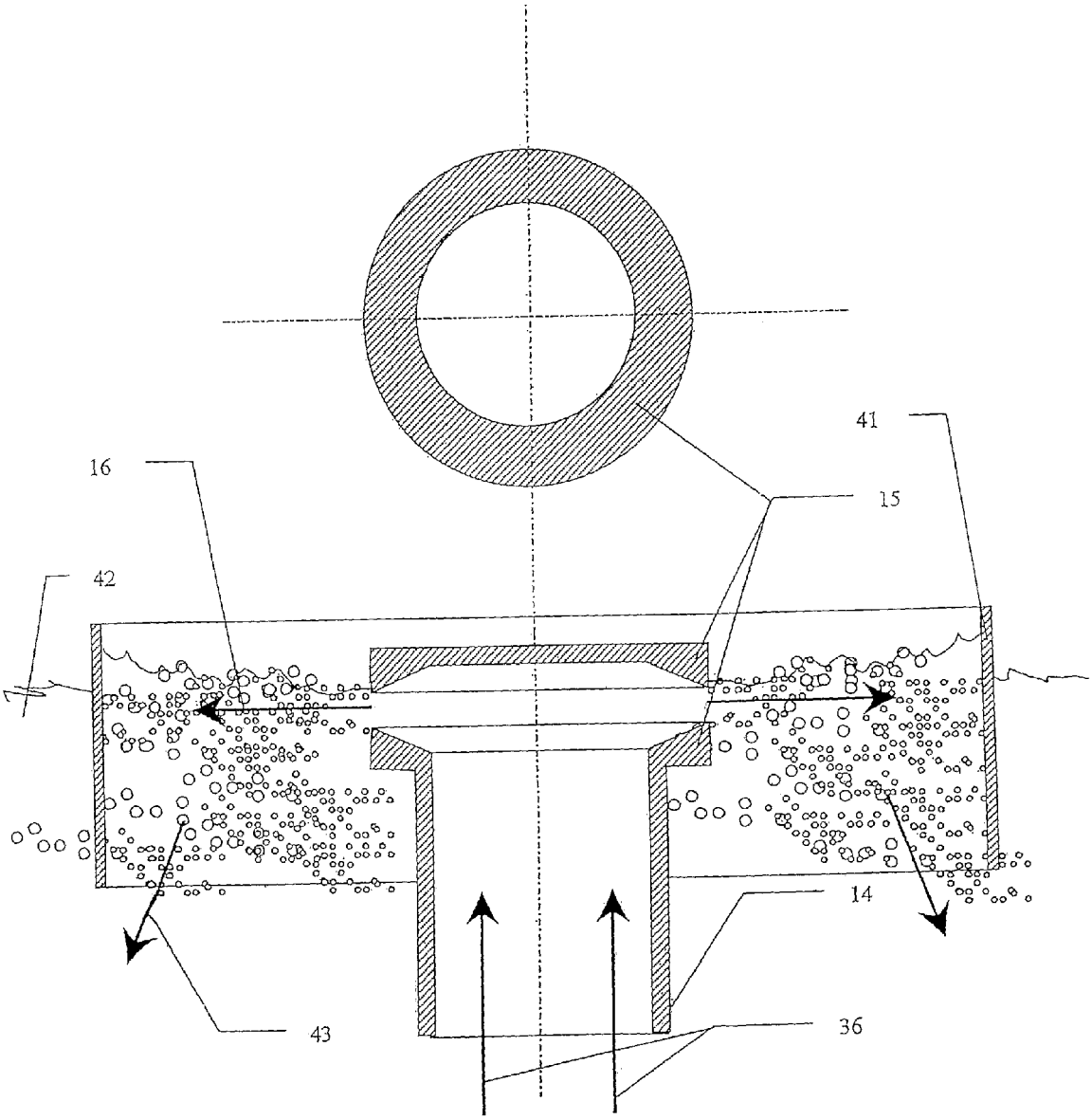

FIG. 2 presents the aeration unit of the apparatus

Figure 3:
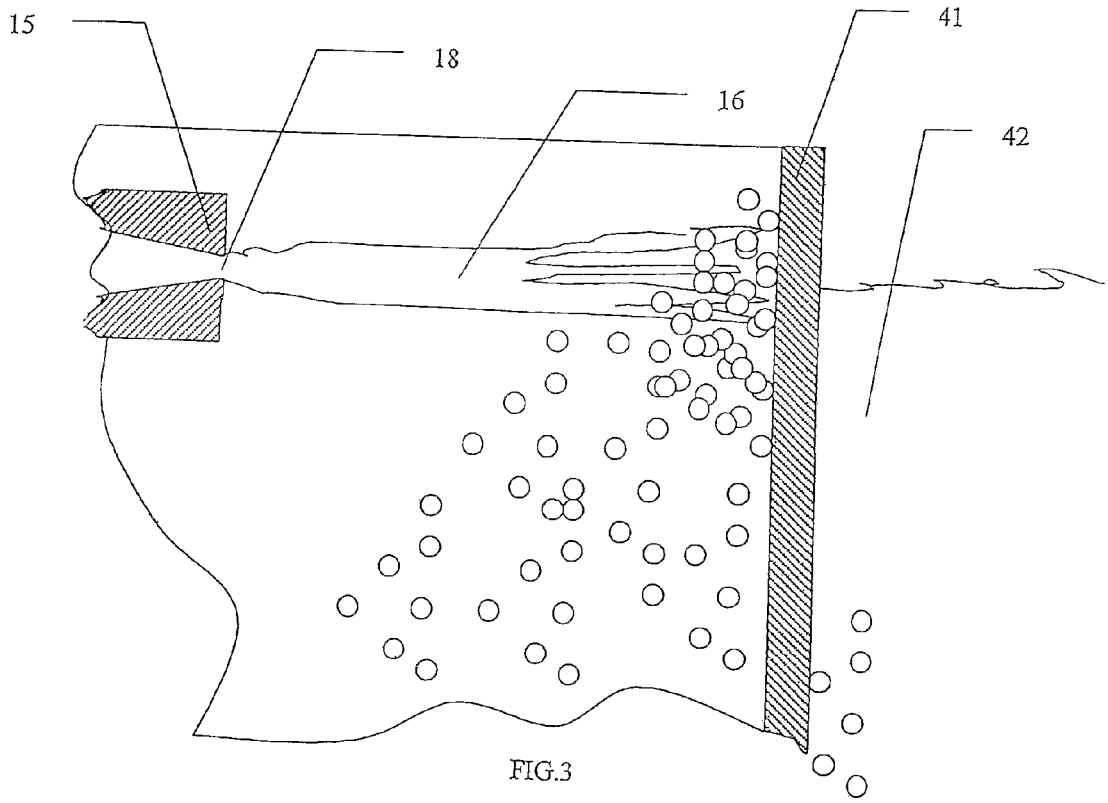

FIG. 3 is a detailed view of the aeration ejector/aeration unit

Figure 4:
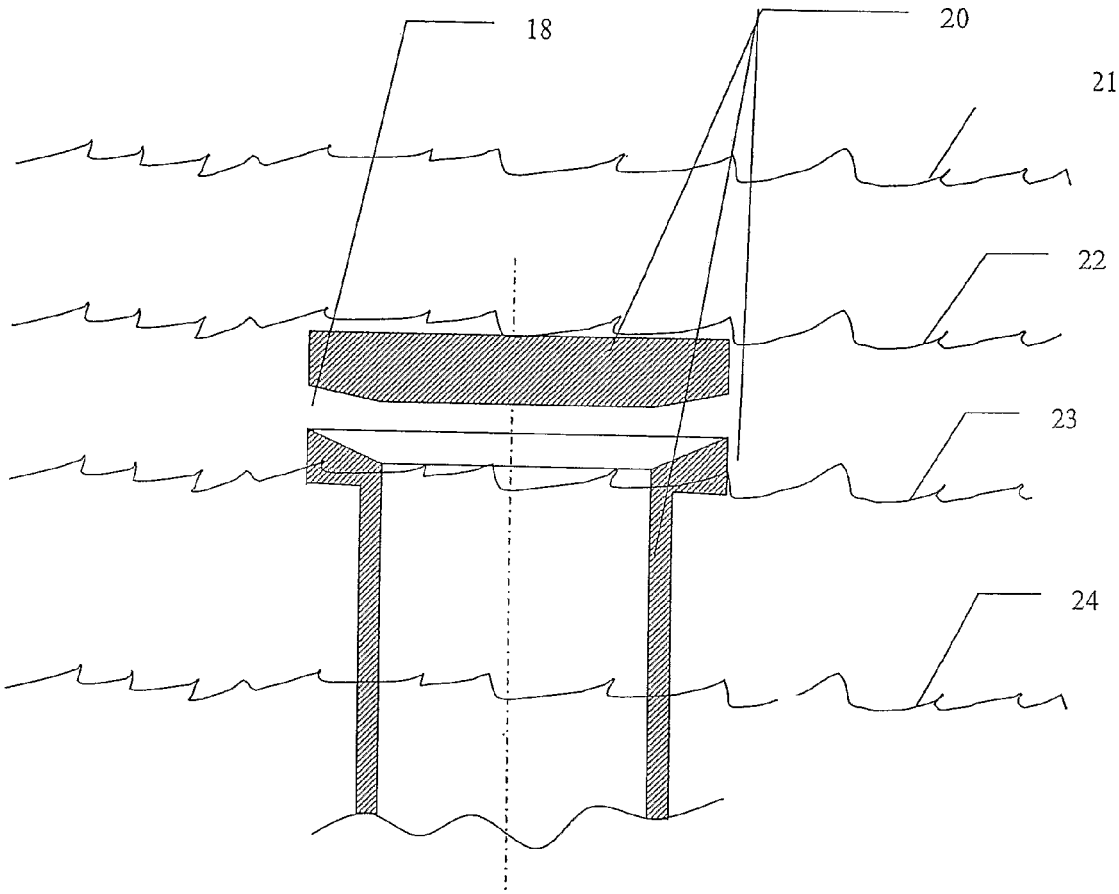

FIG. 4 presents the aeration unit placed in water

Figure 5:
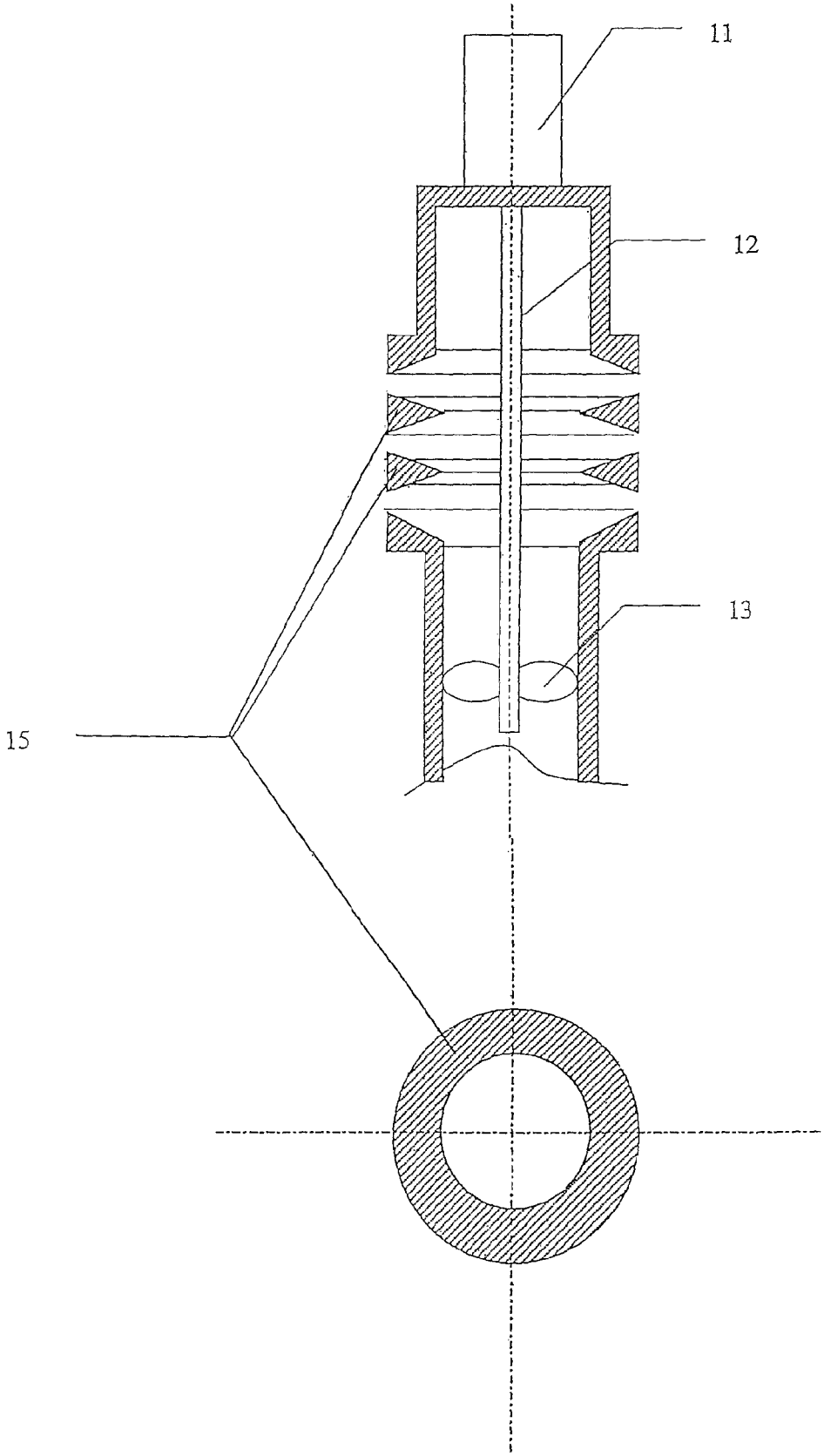
Figure 6:
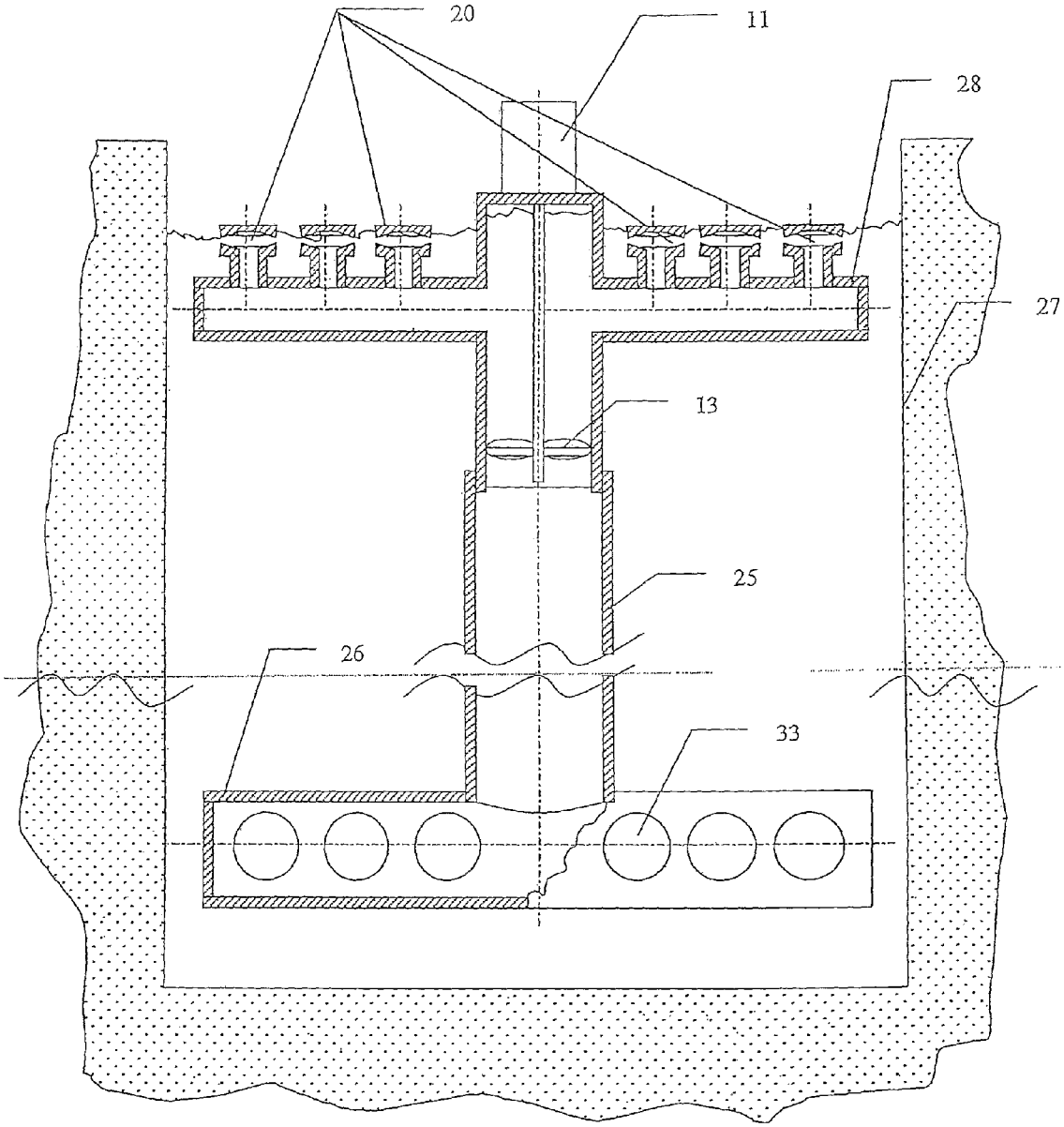
Figure 7:
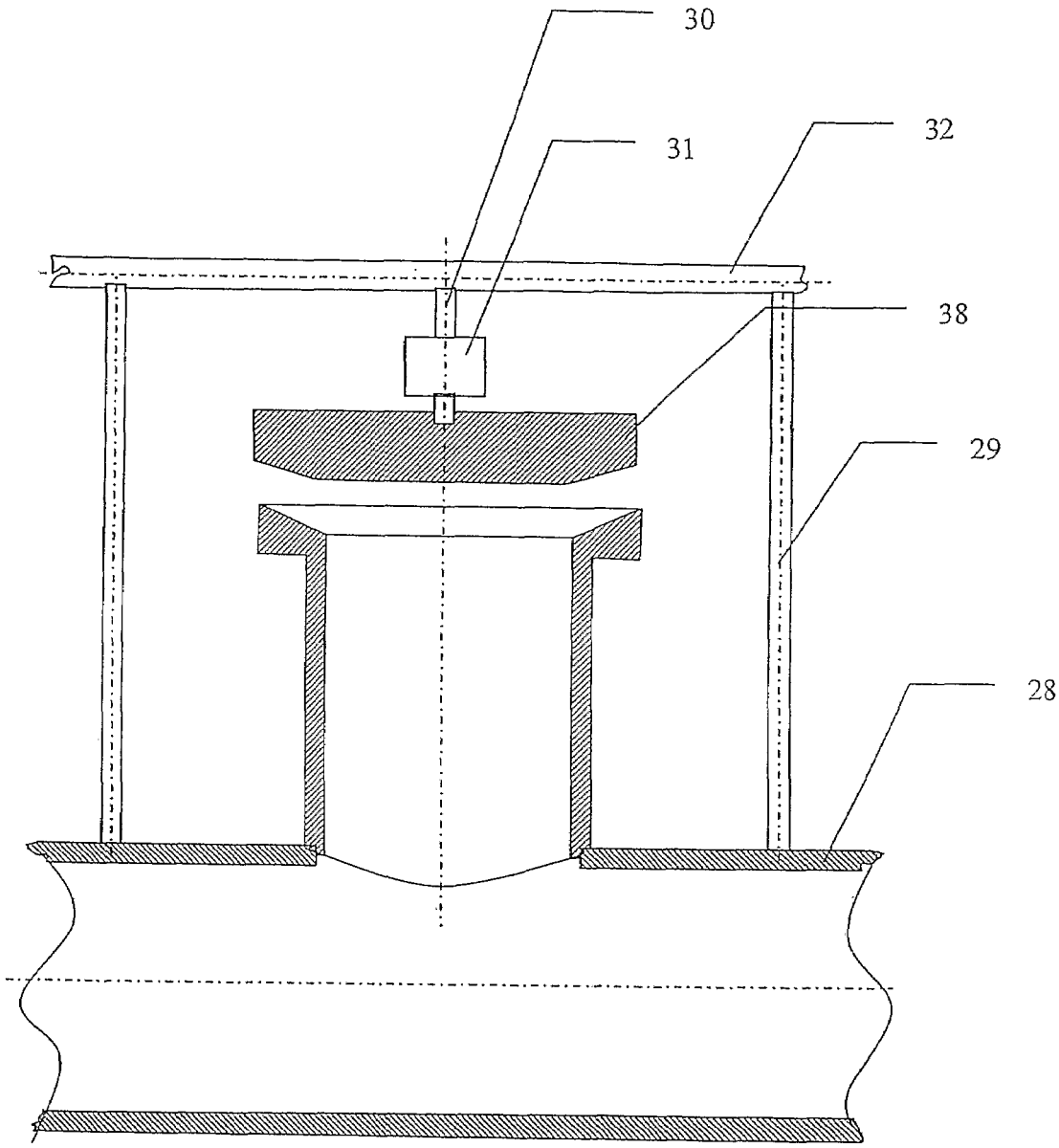
Figure 8:
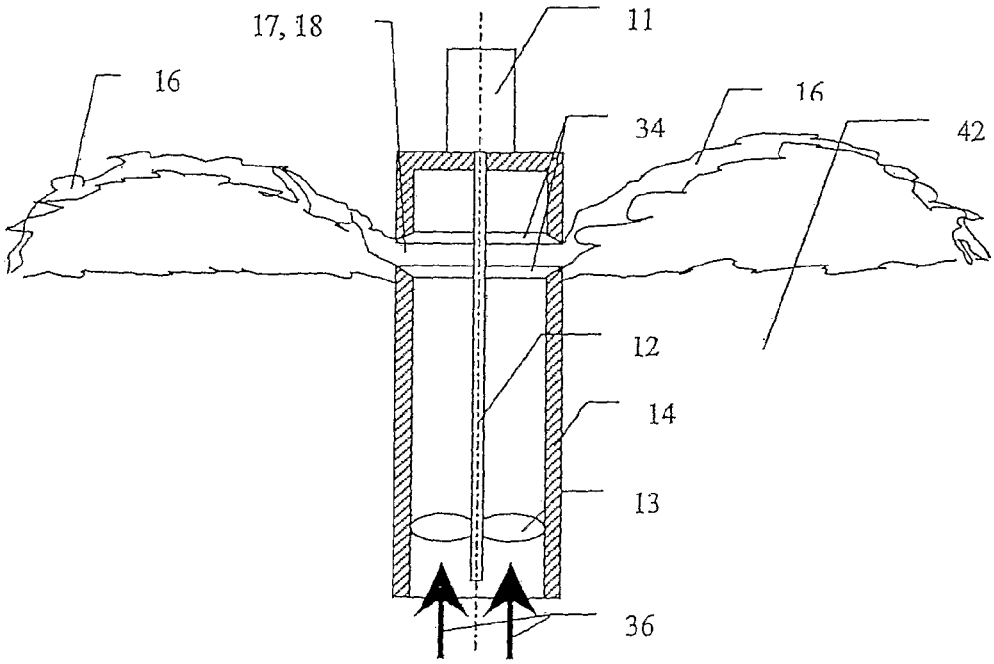
Figure 8:
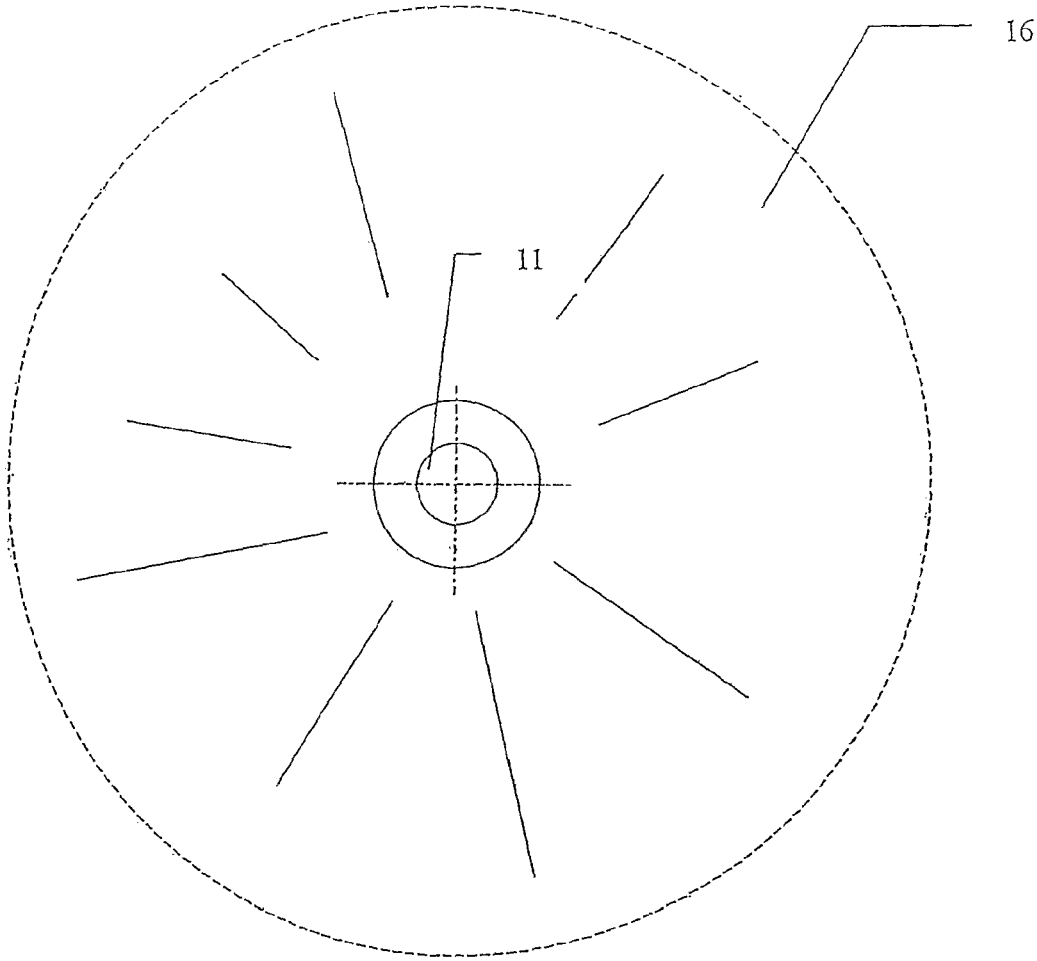

FIG. 5 presents the aeration ejector/aeration unit, wherein the nozzle is divided into several nozzle openings by means of V-shaped nozzle rings FIG. 6 presents the aeration system generally FIG. 7 presents the fastening and adjustment of the cover FIG. 8 presents another embodiment of the aeration unit

DETAILED DESCRIPTION OF THE INVENTION

FIG. 1 presents a cross-sectional view of the apparatus of the invention, in which water is aerated in a basin. The feed pipe therein has been marked with reference number 14. There is a propeller 13 in the feed pipe, which propeller is connected to a motor 11 by means of an axle 12. The propeller pump consists of the motor 11, an axle 12 between the propeller and the motor and of a propeller 13. In the upper end of the feed pipe 14, the water is branched into horizontal nozzle rings 15, the construction of which is such that the inlet consists of conical nozzles 17, which end up to an annular nozzle opening 18. The conical nozzle ends up to a nozzle opening and is abruptly expanding thereafter. An ejector is hereby achieved. The construction between the nozzle rings 15 works as an ejector and causes a water jet 16, which sucks air in itself above and beneath the jet. The water is aerated, the air is efficiently mixed with the water jet and is returned back to the basin. There is usually one nozzle ring 15 on both sides of the aeration unit, but there can also be several of them on each other. The aeration takes place in several phases in accordance with the following description.

The First Step of the Aeration—Pre-Aeration

There is another smaller propeller in the upper end of the apparatus, a propeller 40 for the pre-aeration, which is opposite-handed to the propeller 13 of the propeller pump so that it strives to push the water down. In this way, the propeller 40, which is in the upper end of the axle 12 between the motor and the propeller, mixes air in the turbulent water, which is efficiently mixed with the water and is removed from the aerator through the nozzle 17 in the form of a water jet. The bubbles are in strong movement, or turbulence, during the whole process. The size of the propeller 40 is smaller than the propeller 14 of the propeller pump as the amount of air needed is small and, in addition, a big amount of water could cause a gravitation of the propeller of the propeller pump, which essentially would weaken the function of the pump.

In tests, the pre-aeration increased the production with 5-15%.

The Second Step of the Aeration—the Nozzle Ring and the Water Jet

In the second step, the pressure of the water raised by the propeller pump is converted to kinetic energy.

Water is sucked from the bottom of the basin by means of the propeller pump 13 through the pipe 14. The propeller pump 13 sucks water and lifts it up to the aeration unit. The water arrives to the aeration unit from the feed pipe 14. The conical surface of the nozzle 17 of the aeration unit decreases the flow resistance of the water. In the nozzle 17, the pressure energy is completely converted to kinetic energy. The water jet 16 outwards from the nozzle 17 causes an under pressure, which sucks air to the water jet 16. The water becomes turbulent in the jet and as the under pressure draws air to it, this air is now efficiently mixed with the water and a big part of this oxygen is dissolved in the water, whereby aeration takes place. After the nozzle opening, the jet is quickly expanded in the horizontal plane and simultaneously, the thickness of the jet is decreased in the vertical direction in the same proportion by further increasing the aeration and turbulence. Finally, the water jet meets the outside water, which increases the effect of the mixing and aeration even more or it meets the cylindrical covering 41.

The Third Step of the Aeration—the Water Jet Meets the Wall

The water jet 16 from the nozzle, which water jet consists of water and air, meets the wall that is relatively nearby, in other words the cylindrical covering 41, thereby causing a strong impact, which splits the water jet into small water droplets and air bubbles. In tests, this wall has been 20-50 cm from the outer edge of the aeration unit. The apparatus has to be so high above the water that the jet is not damped (drowned) in the surrounding water, i.e. the aeration unit does not work if it is immersed. In that case any water jet would not be formed, the aeration unit would not be able to suck any air into a water jet and any radical collision with an outer wall, or with the cylindrical covering 41, would not take place. The apparatus aerates efficiently with a water column corresponding to 5-50 cm. If the aeration would be lifted up too high, e.g. 50 cm from the water surface, the pumping power needed would be twice as high (mgh, wherein h=height of water). If the pumping effect is increased with the aeration unit being in the correct depth to the water, such a situation is achieved, wherein the pumping power needed is strongly increased, but the gain of the aeration would no longer increase but very slowly.

So that the collision of the water jet would be as efficient as possible, a cylindrical covering 41 has been built around the aeration unit. When the water jet collides with the covering, the mixture of water and air is mixed and thereby causes aeration. In addition, more air from the surrounding atmosphere is mixed therein at the collision point, which fact increases the efficiency of the aeration.

The Forth Step of the Aeration—the Mixture of Water and Air Ends Up to the Water Below the Cylindrical Covering After that the water has collided with the wall of the covering 41, a big part of the bubbles are mixed with and end up to the water underneath. There are much bubbles and the water now has to exit to the surrounding water 42 through this bubble cloud and under the cylindrical covering 41 or from that 43. Aeration takes place when the water moves through the bubble cloud. The stream inside the cylindrical covering 41 is tried to be dimensioned so that the bubble cloud would continue all the way to the bottom part of the cylinder 41. In this way, the water meets as many bubbles as possible on its way out to the surrounding water 42.

In tests performed with the above-mentioned multi-step aeration, the best results achieved have been over 6.0 $kgO_2$/kWh (the efficiency of the motor 11 of the propeller pump is 80% and the efficiency of the propeller 13 is 70%).

The apparatus can also be used without any cylindrical covering 41. If the edges of the aeration basin are close to the outer edge of the aeration unit a corresponding phenomenon is achieved by making use of the form of the basin and the above-mentioned method/apparatus.

The form of the apparatus can also be something else than a body of revolution. The advantage of using a body of revolution is, however, the big length 18 of the nozzle opening. The gain of the aeration is in proportion to the length of the nozzle opening 18 (e.g. when the diameter is 30 cm at the nozzle opening, the length of the nozzle opening is $\pi \times 30$ cm, or ca 94 cm).

Water of for example 4° C. is completely saturated when 13.1 mg $O_2$/liter oxygen has been dissolved therein in the normal atmosphere. Therefore the distance between the nozzle rings 15 should be as big as possible so that as much water as possible could be aerated (big flow-through of device). On the other hand, when this distance (the nozzle opening) becomes too big there is not enough air mixed with the water or it is not mixed uniformly enough and no air at all can move below the jet. Because of this fact, and if bigger oxidation amounts are wanted, the diameter of the nozzle rings 15 shall be increased. The level of oxidation is directly proportional to the diameter 18 of the nozzle opening. In other words, if a doubled capacity is wanted, the diameter 18 of the nozzle openings has to be doubled. If the capacity need is considerable, the resulting solutions are expensive. Two solutions to this are described later on.

It is essential in this invention that the jet is formed in the annular opening, whereby the jet is reduced when the radius increases. Good results were achieved in tests when the diameter of the nozzle opening was 75 mm and 290 mm. In the contrary, when the diameter of the nozzle opening was 750 mm, the result was bad. This is a consequence of the fact that the water jet did not expand so fast anymore in the horizontal plane and thus it did not become thinner in the vertical direction, which is a condition for an efficient aeration in this method. Example: The radius of the nozzle opening is 40 mm and the water jet outwards from the nozzle opening has the length of 360 mm. Then the water jet having a thickness of 20 mm has become thinner in the end of the water jet having a thickness of only 2 mm. If the radius of the nozzle opening would have been 720 mm and the length of the jet 360 mm, the jet would only have reduced to a thickness of 14 mm.

FIGS. 2 and 3 present the aeration unit more in detail. FIG. 3 is a detailed picture of the aeration unit, wherein the things explained in connection with FIG. 2 are clearer. The water comes between the nozzle rings 15 after the feed pipe 14. The upper and lower nozzle rings form an ejector (the upper nozzle ring continues and forms here also a cover). The conical nozzle rings 15 form a nozzle 17, that ends up to an annular nozzle opening 18. The speed of the water increases in the nozzle 17 and the pressure energy is converted to kinetic energy. The nozzle opening expands abruptly when the nozzle rings end. The water jet 16 streaming out from the opening forms an under pressure. The air above the jet 16 is sucked into the jet 16. The under pressure formed beneath the jet 16 sucks air to the jet as well. Air is also absorbed through the jet from above. The absorbed air is mixed with the water and moves along with the water. In this opening the water jet takes a part of the air with itself. In this way, such conditions, that are as advantageous as possible, have been created for the mixing of the water and the air. As only a little oxygen is dissolved into the water, the amount of air fed shall be relatively small. This is achieved with right dimensions for the nozzle. So that the air bubbles coming further to the water jet would be as evenly distributed as possible, the height of the nozzle opening 18 shall be relatively small. The best results have been achieved when the height of the nozzle opening has been 10-45 mm.

The water comes along the feed pipe in the direction of the arrows 36 to the aeration unit. The water 16 is removed between the nozzle rings 15 according to arrow 37 to the surrounding water in the form of a jet. The water achieves its highest speed in the narrowest point, i.e. in the nozzle opening 18, from which it is ejected outwards in the direction of the surface of the surrounding water or diagonally upwards. The nozzle 17 works as an ejector by absorbing air to the water jet from outside. The water that is ejected outwards absorbs air and mixes it efficiently with the water by causing aeration of the water, i.e. dissolving of oxygen in the water. When the water jet is thin enough water is absorbed from both sides of the water jet, above and beneath. The bubbles are very small and in this way there is formed a contact surface as big as possible between the air and the water thereby causing an efficient dissolving of oxygen into the water. The efficiency of the mixing is increased by a step, in which the mixture of water and air collides with the outside water mass or the cylindrical covering 41. The apparatus was also tested so that additional holes led to the nozzle opening, through which holes more air was received in them. The dissolving of oxygen was decreased as the size of the bubbles increased and there was relatively seen unnecessary much air in the water.

Before entering of the water in the nozzle 17, the surfaces are treated to be conical in order to make the energy consumption as low as possible. The construction of the upper part of the aeration unit appears from the figure. The lower part is otherwise identical except for the feed pipe connected thereto.

The solution described above provides several essential advantages:

1. The jet is formed in a long annular horizontal or upwardly diagonal nozzle opening, which is relatively wide and formed of conical pieces, whereby the flow resistance is as small as possible. Furthermore, the amount of energy needed for the circulation of the water and for the achieving of the jet is very small (in tests the best result was achieved with a water column corresponding to 5-50 cm).
2. No such particles or contaminations are collected in a wide opening that could obstruct the aerator. If there were much small holes in the aerator they would easily be clogged.
3. The jet proceeds after the opening in a horizontal or upwardly diagonal direction somewhat above the water surface in the form of a uniform water ring, whereby its thickness is decreasing all the time. The water ring/water jet covers 360° or a part/parts of a big sector.
4. The jet collides with the surface of the water or the solid cylindrical covering being as thin as possible at the collision. In the collision, the jet is split into small droplets, whereby these small droplets are aerated.
5. With the above described apparatus of the method the same production is achieved with an energy consumption that is ca two times smaller compared to other surface aerators, in other words, the aerator in question needs only a fractional part of energy to produce the same production as other similar apparatuses.

FIG. 4 presents an aeration unit placed in water. It is important that the aeration unit 20/nozzle opening 18 is placed into the right depth 22 (a depth in which the water jet has not jet been essentially damped), 23 (the nozzle opening 18 is completely above the water surface but near the water surface) of the water. If the apparatus is too deep in the water 21, no water jet is formed and the aeration unit can not absorb any air at all through the water. Then the apparatus does not aerate at all, the water only flows through it thereby causing mixing without aeration. If the apparatus is too high in relation to the water surface 24, the energy consumption at the pumping of the water increases, but the result does not improve. If for example a water column of 20 cm is used in order to achieve the movement and aeration of the water, a water column of 40 cm above the surface of the water is needed when the apparatus is 20 cm (mgh, wherein h=height of water). Then 50% of the energy is lost. The aeration unit is placed in accordance with FIG. 4, whereby the apparatus works as it should and the energy consumption is minimized. The apparatus is placed in water so that the water jet is clearly distinguished and the aeration unit absorbs air also from or to below the jet 16 but still as down as possible so that any unnecessary pumping of the above kind would not be needed. As an example it is mentioned that when the nozzle opening 18 is partly or completely under the water surface but not deeper than that, a high efficiency is achieved.

FIG. 5 presents an aeration ejector, wherein the nozzle is divided into several nozzle openings by means of wedge-shaped nozzle rings 15. Thus, nozzle rings of the above-described kind are added and in this way, additional capacity is achieved. These new nozzle rings are symmetrical, in other words, the upper and lower edges of them are similar. Increasing capacity by increasing the diameter of the nozzle rings becomes expensive after a given point and also unpractical. Additional nozzle rings 15 can be added to the aeration apparatus of FIG. 1 in accordance with FIG. 5. Each nozzle ring 15 works in the same way as the earlier described nozzle rings in the aeration units. The capacity of the apparatus can be considerably increased by means of additional nozzle rings. Two nozzle rings have been added in the apparatus of FIG. 5, whereby there are three nozzle openings. Then, the production of the aeration unit in question is three times higher compared to an aerator with only one nozzle opening. There can be one or more additional nozzle rings 15.

FIG. 6 presents an aeration system containing several aeration units 20. Big systems have often several aeration units 20 in accordance with FIG. 6 in order to achieve a sufficient aeration capacity. It, however, has to be noted that such a solution normally only contains one pumping unit. A better efficiency is achieved for the pumping with only one bigger pumping unit. Water is ejected from the aeration units 20, and this water is efficiently oxidized. As the process, e.g. bacteria, all the time eats oxygen from the water, the oxygen concentration is considerably lower in the bottom of the basin than at the surface. When the feed pipe extends to the bottom of the basin, the efficiency of the aeration is maximized since more oxygen is solved into oxygen-poor water than into oxygen-rich water. Reference number 28 is a transversal feed pipe along which the water is simultaneously fed to several aeration units. Reference number 27 describes the wall of the basin. Reference number 25 presents the extension of the feed pipe 14, whereby the water can be sucked and then pumped even if the basin is very deep. There can be several feed pipe extensions. Reference number 26 is a transversal feed pipe with suction holes 33. The suction holes can be at the same side, whereby a unidirectional flow is achieved or they can be on different sides of the transversal feed pipe in accordance with FIG. 6, whereby the water of the basin are brought in a rotating movement on the bottom of the basin. Reference number 33 describes the suction holes intended to suck water in the apparatus.

The aeration system in question mixes water efficiently during the aeration. The water flows/streams out from the aeration units and, on the other hand, it is sucked all the time. This results in a strong flow movement and a mixing of the water in the whole basin. It is often important in treatment of wastewaters that the mixing is continued even if the aeration is stopped. This is performed so that the output of the pumping is lowered with an inverter, e.g. by halving the rotation speed. Then the water flows slower through the nozzle with no aeration. An other possible way for mixing the water without aeration is to change the direction of rotation of the motor.

Then the water is taken in via the aeration units 20 and is pumped out through the feed pipe by causing a jet under the water without aeration. This is an efficient way to mix the water in the basin. In the lower part of the feed pipe there can furthermore be an additional pipe in accordance with the figure, a transversal feed pipe 26 with suction holes 33, with which the mixing is intensified. Suction holes are made in this pipe and the circulation and mixing of the water are controlled in this way. For example, a part of the suction holes can be at the front side of the pipe and part of them in the rear side, in which way turbulence of the water can be achieved in the basin.

The water feed pipe 14, 25 can consist of one pipe or, when necessary, several pipes can be placed one after another (a feed pipe and e.g. two successive extensions of the feed pipe). The feed pipes used can be standard pipes used for heating, plumbing and air conditioning. With such a construction, very deep basin can be aerated.

The cover 38 of the aeration unit can be externally fastened in accordance with FIG. 7 (the cover extends at the same time by forming the upper nozzle ring 15). In this case, the aeration unit does not contain any fasteners to which dirt could adhere. The impurities in the wastewater, such as hairs and tooth sticks, can easily clog an apparatus in which the fasteners or screws are inside the apparatus and in contact with the flowing water.

The cover 38 of the aeration unit can furthermore be adjusted in the vertical direction (raised and lowered) by means of an actuator 31. If the cover 38 is raised in a sufficient extent, the water can flow freely beneath the cover 38 without aeration to take place. An efficient mixing is hereby achieved. An additional advantage is that the pressure in the pipe system decreases and hereby also the energy consumption. When the cover 38 of the aeration unit is lowered such a situation is achieved, wherein the aeration starts. When the lowering of the cover 38 is continued further, the production of the aeration grows since the pressure in the pipe system increases and this pressure, in turn, is converted to kinetic energy in the nozzle. The higher speed in the nozzle 36, the bigger production of the aeration unit. When the pressure in the pipe system grows, the energy consumption grows at the same time. As there are several aeration units, a part of them can be shut by pressing down the cover 38 so much that it is shut and the flowing of water through the aeration unit is prevented. When for example an apparatus has 20 aeration units, 14 can be shut, whereby the production decreases with 70%. At the same time also the propeller pump is adjusted so that its production (flow) decreases with 70% so that the pressure in the aeration units can be kept constant.

The apparatus of the invention can be used also for oxidizing natural waters. In this case, the apparatus sucks oxygen-poor ground water to the apparatus, wherein the water is oxidized and it returns to the surface of the lake. During the winter season, the warmer ground water maintains an open hole in the ice. If the temperature graduation of the lake is wished to be maintained, the oxidized water can be lead deeper with a return pipe.

As the efficiency of both the propeller and the motor raises with growing size, it is usually worth using relatively big units, whereby the same pump unit feeds water to several aeration units.

When the aeration takes place at the surface of the water, saturated gases in the water are released in connection with the aeration, such as nitrogen, carbon dioxide, ammonia and radon.

In batch purification, the different steps in the water purification takes place successively in the same space. In this case, the apparatus can be used after aeration for example for removal of nitrogen by stopping the oxidation but by continuing the mixing. In this way, the aerobic and the anaerobic steps of the process can be repeated alternately in the same basin.

The aeration apparatus of FIG. 8 is otherwise the same as the apparatuses presented earlier in FIGS. 1-3. The propeller pump consists of a motor 11, an axle 12 between the motor and the propeller and a propeller 13. The pump sucks water from the lower end of the feed pipe 14 and pushes it upwards 36 against the nozzle 17.

The apparatus of FIG. 8 does not contain any separate nozzle rings, instead, the task of the nozzle rings is taken car of by a cut 34 in the feed pipe. In the apparatus of the figure, the nozzle 17 and the nozzle opening 18 has been achieved by sawing or by making a hole around the pipe in another way. The nozzle opening has the same thickness all the way, e.g. 20 mm. So that the nozzle 17, the nozzle opening 18 and the feed pipe 14 would be of the same piece, bearers can be left in the pipe. In practice, there can be more or less of them. If such water is aerated that easily can clog the nozzle and the nozzle opening, the fastening can be performed externally in accordance with FIG. 7, when there are no bearers in the nozzle. In that case, the nozzle 17 and the nozzle opening 18 do not clog.

As appears in FIG. 8, the jet typically covers 360°.

In the apparatus of FIG. 8, the walls of the feed pipe 14 are relatively thin, whereby the conical nozzle 17 remains short. Because of this, the water jet 16 is ejected diagonally upwards (the pump brings the water to stream up along the feed pipe from down in accordance with arrows 36). The water jet 16 is hereby longer and a more complete aeration takes place during the water jet 16 before colliding with the external water 42. Also in the earlier FIGS. 1-3, the nozzle rings 15 can be formed so that the water flows diagonally upwards. The result of the aeration is so good when the jet is directed diagonally upwards that any separate cylindrical covering 41 is not needed.

While the present invention has been described in accordance with preferred compositions and embodiments, it is to be understood that certain substitutions and alterations may be made thereto without departing from the spirit and scope of the following claims.

The invention claimed is:

1. An aeration system for aeration and/or mixing of water, comprising:

at least one aeration unit having a pump/propeller inside a feed pipe, with which propeller/pump the water is sucked into a feed pipe, and the feed pipe to which the water to be aerated is sucked from beneath;

a nozzle ring in the aeration unit, and which feed pipe expands in an upper part of the aeration unit by forming a conical space that works as a nozzle, the nozzle ring having at least one nozzle opening defined therein, the nozzle ending in at least one annular nozzle opening;

the aeration unit being placed in the water to a right depth in such a way that the water flow caused by a pump/propeller goes to one or more of the annular nozzle openings at or close to a surface of the water; and another smaller propeller being disposed in the upper part of the system, the other propeller being different handed compared to the propeller of the propeller pump.

2. The aeration system of claim 1 wherein the nozzle opening is vertical in order to bring the water jet horizontally out from the feed pipe.

3. The aeration system of claim 1 wherein the nozzle opening slants diagonally upwards in order to bring the water jet diagonally upwards out from the feed pipe.

4. The aeration system of claim 1 wherein the conical space in the upper part of the aeration unit is between the nozzle rings.

5. The aeration system of claim 1 wherein there is cylindrical covering around the aeration unit.

6. The aeration system of claim 1 wherein a wedge-formed nozzle is formed between the nozzle rings, which nozzle ends to the annular nozzle opening.

7. The aeration system of claim 1 wherein the nozzle ring of the aeration unit is formed by a cover, which is externally fastened and the oxidation and/or mixing can be regulated by adjusting a position of the cover.

8. The aeration system of claim 1 wherein the nozzle is divided into several nozzle openings by means of wedge-formed nozzle rings.

9. An aeration system for aeration and/or mixing of water, comprising:

at least one aeration unit having a pump/propeller inside a feed pipe, with which propeller/pump the water is sucked into a feed pipe, and the feed pipe to which the water to be aerated is sucked from beneath;

a nozzle ring in the aeration unit, and which feed pipe expands in an upper part of the aeration unit by forming a conical space that works as a nozzle, the nozzle ring having at least one nozzle opening defined therein, the nozzle ending in at least one annular nozzle opening;

the aeration unit being placed in the water to a right depth in such a way that the water flow caused by a pump/propeller goes to one or more of the annular nozzle openings at or close to a surface of the water, and wherein there are several aeration units and a transversal feed pipe or transversal feed pipes, along which the water is lead to the aeration units.

10. The aeration system of claim 9 wherein one feed pipe, pump and motor feed the water to several aeration units simultaneously.

11. An aeration system for aeration and/or mixing of water, comprising:

at least one aeration unit having a pump/propeller inside a feed pipe, with which propeller/pump the water is sucked into a feed pipe, and the feed pipe to which the water to be aerated is sucked from beneath;

a nozzle ring in the aeration unit, and which feed pipe expands in an upper part of the aeration unit by forming a conical space that works as a nozzle, the nozzle ring having at least one nozzle opening defined therein, the nozzle ending in at least one annular nozzle opening;

the aeration unit being placed in the water to a right depth in such a way that the water flow caused by a pump/propeller goes to one or more of the annular nozzle openings at or close to a surface of the water; and a transversal suction pipe being near a bottom and suction holes in the transversal suction pipe adapted for intensifying the mixing.

12. A method for aeration/mixing of water in an aeration unit, comprising:

providing a propeller/pump inside a feed pipe, with which propeller/pump the water is sucked into the feed pipe and a feed pipe, to which the water is sucked from beneath and a nozzle ring of the aeration unit, achieving a water stream with the propeller pump leading the water stream to the feed pipe of the aeration unit, which is in the water, leading the water from the feed pipe via such a part in the upper part of the feed pipe that works as a nozzle and extending as a conical space and is lead further to one or more annular nozzle openings ending to the nozzle at or near by a surface of the water, leading the water away via a nozzle opening in a form of a water jet, providing another smaller propeller in an upper end of the system that is different handed compared to the propeller of the propeller pump, and performing a pre-aeration as a first step, wherein water is pushed by the propeller downwardly and air is mixed with the water, and the water is removed from the aerator via the nozzle in the form of the water jet.

13. The method according to claim 12 wherein when there is a cylindrical covering around the aeration unit, the water jet from the nozzle is, in a third step of the aeration, allowed to collide with the cylindrical covering working as a wall in order to split the water jet into small water droplets and air bubbles.

14. The method according to claim 12 wherein the apparatus is used for the circulation of water, whereby the apparatus is lowered so that the nozzles come under the water or by raising the covering of the aerator and/or by lowering the rotation speed of the motor.

* * * * *